United States Patent [19]

Potter

[11] Patent Number: 4,718,885

[45] Date of Patent: Jan. 12, 1988

[54] SWINGING BUCKET CENTRIFUGE ROTOR HAVING AN UNINTERRUPTED KNIFE EDGE PIVOT

[75] Inventor: Raymond G. Potter, Southbury, Conn.

[73] Assignee: E. I. Du Pont de Nemours and Company, Wilmington, Del.

[21] Appl. No.: 943,136

[22] Filed: Dec. 18, 1986

[51] Int. Cl.[4] ..... B04B 5/02

[52] U.S. Cl. ..... 494/20

[58] Field of Search ..... 494/20, 16, 17, 18, 494/21, 85; 422/72

[56] References Cited

U.S. PATENT DOCUMENTS

| | | | |
|---|---|---|---|
| 263,053 | 8/1882 | McCollin . | |
| 1,839,944 | 1/1932 | Barthels . | |
| 1,997,919 | 4/1935 | Strezynski | 233/26 |
| 3,361,343 | 1/1968 | Lerner | 233/26 |
| 3,393,864 | 7/1968 | Galasso et al. | 233/26 |
| 4,400,166 | 8/1983 | Chulay et al. | 494/20 |
| 4,435,167 | 3/1984 | Stower | 494/16 |
| 4,585,433 | 4/1986 | Cole | 494/20 |
| 4,585,434 | 4/1986 | Cole | 494/20 |
| 4,586,918 | 5/1986 | Cole | 494/20 |
| 4,589,864 | 5/1986 | Cole | 494/20 |

FOREIGN PATENT DOCUMENTS

| | | |
|---|---|---|
| 1782602 | 3/1972 | Fed. Rep. of Germany . |
| 296421 | 2/1954 | Switzerland . |
| 505446 | 5/1939 | United Kingdom . |

*Primary Examiner*—Robert W. Jenkins

[57] ABSTRACT

A top loading swinging bucket centrifuge rotor is characterized by the provision of a sample container pivot support member having a knife edge thereon which engages a surface of a sample container along an uninterrupted line of contact as the container pivots from an initial to a second position.

5 Claims, 3 Drawing Figures

SWINGING BUCKET CENTRIFUGE ROTOR HAVING AN UNINTERRUPTED KNIFE EDGE PIVOT

BACKGROUND OF THE INVENTION

1. Field of the Invention

The present invention relates to a centrifuge rotor of the swinging bucket type and in particular to a top loading swinging bucket centrifuge rotor having a single uninterrupted knife edge pivot element supporting a sample container.

2. Description of the Prior Art

A centrifuge rotor of the type in which a sample container carrying a sample of the material to be centrifuged moves from an initial position in which the axis of the sample container is substantially parallel to the vertical center line of the rotor to a second position in which the axis of the sample container lies substantially in a plane perpendicular to the vertical center line of the rotor is known as a swinging bucket rotor.

In one typical arrangement the sample container, or bucket, used with such a rotor includes outwardly projecting elements, or trunnion pins, having a portion defining a substantially cylindrical bearing surface. The trunnion pins are typically received in corresponding support arms that are provided with conforming trunnion receiving sockets. Alternatively, the trunnion pins may be located on the arms with the corresponding sockets being disposed on the container.

In either event the bearing surface on the trunnion pin bears against the surface of the trunnion receiving socket in which it is received throughout the pivotal movement of the sample container from the initial to the second position. The trunnion receiving socket therefore acts both as the surface which supports the bearing surface on the trunnion pin and as the constraining and guiding surface which insures the controlled movement of the sample container from the initial to the second position. U.S. Pat. No. 4,400,166 (Chulay et al.), U.S. Pat. No. 3,752,390 (Chulay), U.S. Pat. No. 3,393,864 (Galasso et al.), U.S. Pat. No. 263,053 (McCollin), U.K. Pat. No. 505,446 (Baird and Tatlock), German Pat. No. 1,782,602 (Heraeus-Christ) and Swiss Pat. No. 296,421 (Willems) disclose typical examples of such rotors.

The abrading action which occurs between the bearing surface on the trunnion pin and the socket is believed to be disadvantageous for several reasons. First of all, the abrasion results in the wearing of metal which must be closely monitored. To counteract this result hardened materials are used for the pins and the sockets. Furthermore, trunnion pins require that the structure to which they are mounted exhibits relatively large radii in order to reduce trunnion stress and contact stress.

In U.S. Pat. No. 4,435,167 (Stower) an alternative support arrangement is disclosed which eliminates the above-discussed abrading action by use of a rolling profile to engender rolling action between one or more profiled surfaces. However, such an arrangement appears to prevent orientation of the container with its axis completely parallel to the vertical axis of the rotor. A rolling profile precludes the axis of the sample container from reorienting to a true vertical position after centrifugation. At zero rotational speed the sample container will hang in a true vertical position only if the line of restraint is directly in vertical alignment with the center of gravity of the sample container on the centerline of the container. The line of restraint is that location where the forces on the container are reacted. Likewise, under high speed rotation the container will assume a horizontal orientation only if the line of restraint is in the horizontal plane of the center of gravity of the container on the centerline of the container. With a rolling profile the center of gravity of the container cannot align with the line of restraint so that the container is unable to be both oriented substantially vertically while in the rest position and substantially horizontally while at speed. Since it is desirable in operation to have the axis of the sample container align with the centrifugal force field, it follows with the Stower structure that as the rotor slows and stops the axis of the container will not hang in a true vertical position.

A top loading centrifuge rotor which avoids the abrading action of the typical trunnions and the rolling action of an arrangement such as that shown in the above-discussed Stower patent is disclosed and claimed in U.S. Pat. No. 4,585,434, issued in the name of Paul M. Cole and assigned to the assignee of the present invention. This patent discloses and claims a mounting arrangement that includes a pair of knife edge pivot elements arranged to contact and support a sample container for pivotal movement along an interrupted line of contact.

In view of the foregoing, it is believed advantageous to provide a mounting arrangement for a top loading centrifuge rotor that supports the pivotal motion of the sample container from the initial to the second positions and which eliminates the shifting of the container's line of restraint and yet which does so using only a single uninterrupted line of pivotal contact.

SUMMARY OF THE INVENTION

The present invention relates to a centrifuge rotor of the swinging bucket type that includes a plurality of sample container pivot support members disposed in equiangularly spaced circumferential relationship about the rotor. The pivot support member includes a knife edge that receives and supports a pivot surface of a sample container along an uninterrupted line of contact.

In the preferred embodiment the rotor includes a hub having an array of pivot support members in the form of radially outwardly extending hangers each having a knife edge thereon. A sample container includes a hook-shaped appendage extending upwardly therefrom. The appendage carries a pivot surface on which an uninterrupted line of contact with the knife edge of the hanger is defined.

BRIEF DESCRIPTION OF THE DRAWINGS

The invention will be more fully understood from the following detailed description thereof taken in connection with the accompanying drawings which form a part of this application and in which.

DETAILED DESCRIPTION OF THE INVENTION

Figure 1:
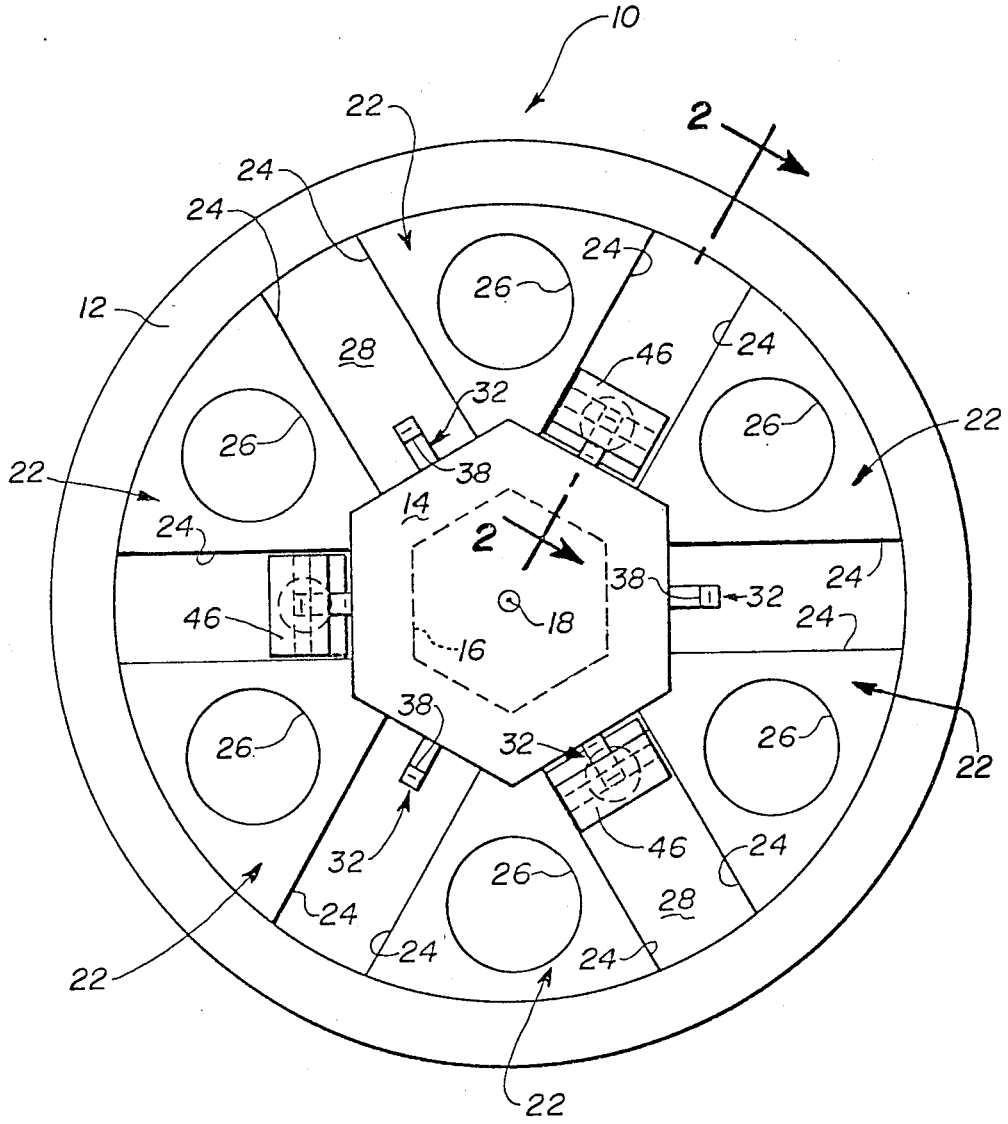
FIG. 1 is a plan view of a top loading swinging bucket centrifuge rotor in accordance with the present invention.

Throughout the following detailed description similar reference characters refer to similar elements in all Figures of the drawings.

Figure 2:
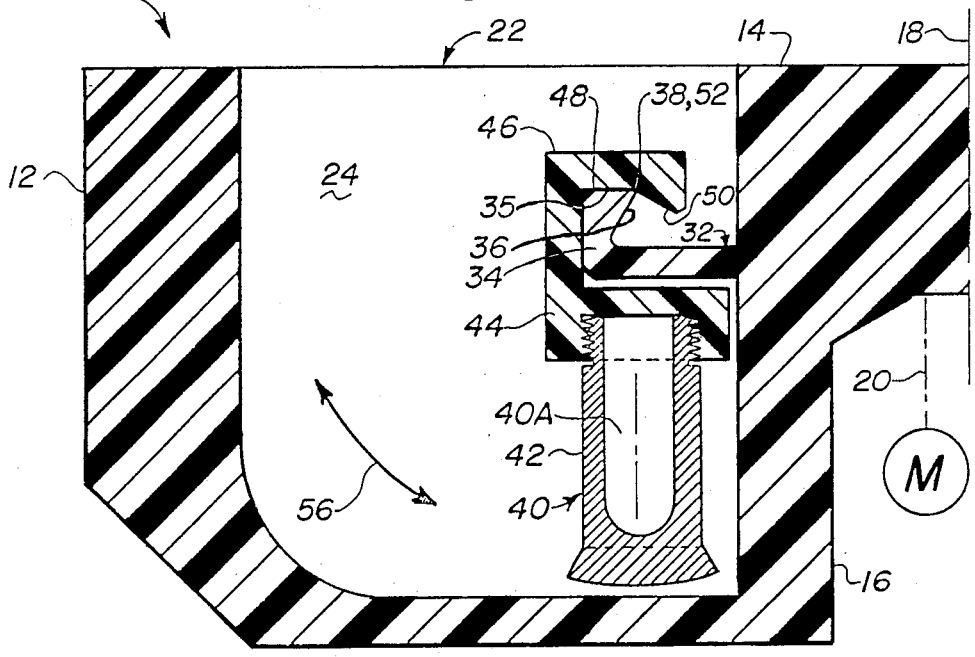
FIG. 2 is a sectional view taken along section lines 2—2 of FIG. 1 showing the sample container in an initial, rest, position.

With reference to FIGS. 1 and 2 respectively shown is a plan view of a top loading centrifuge rotor generally indicated by reference character 10 embodying the teachings of the present invention and a side sectional view of the same.

The rotor 10 includes a substantially hollow, open topped bowl-shaped member 12 that having a central core portion 14. The core 14 is recessed, as at 16, to receive in driving engagement a drive adapter (not shown). The drive adapter serves as the interconnecting element whereby the rotor 10 is connected through a connection schematically indicated at 20 (FIG. 2) to a centrifuge drive motor M so as to rotate the rotor 10 about its vertical axis 18. Of course, any suitable form of interconnection between the rotor 10 and its motive source may be used.

An array of substantially wedge shaped segments 22 with radially extending sidewalls 24 are received within the bowl 12. The segments 22 may be recessed, as at 26, to eliminate extra mass.

The radially confronting sidewalls 24 of circumferentially adjacent wedges 22 cooperate to define spaces 28 equiangularly located about the core. Any alternate arrangement which defines the spaces 28 may, of course, be used. The use of an arrangement to reserve spaces 28 may also be eliminated, if desired.

Projecting radially outwardly from the core 14 into each of the spaces 28 is a sample container pivot support member 32. The pivot support member takes the form, in the preferred case, of an L-shaped hanger. The hanger 32 includes an upwardly projecting arm 34 as shown in FIG. 2. The arm 34 has a planar mounting surface 35 which is undercut, as at 36, from the upper, inner edge 38 thereof.

A sample container 40 includes a cylindrical cannister 42 that is hollowed to either directly receive a sample of material to be centrifuged or, alternatively, to receive a test tube or like vessel in which the sample is carried. Threadedly securable to the upper end of the cannister 42 is a cap 44. The cap 44 has an upwardly projecting hook-like appendage 46 mounted thereon. Pivotal motion of the container 40 occurs on a pivot surface defined on the underside of the appendage 46, in manner to be discussed. The pivot surface on the underside of the appendage 46 includes a substantially planar mounting surface 48 that intersects with a downwardly flaring restraining surface 50 along a junction line 52.

Figure 3:
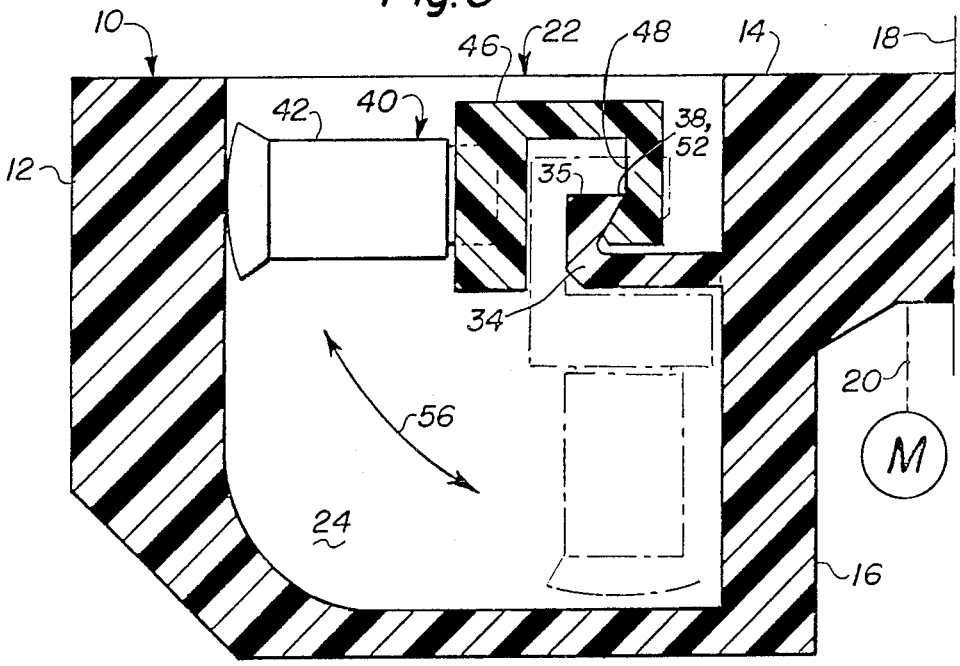
FIG. 3 is a view similar to FIG. 2 showing tha sample container in the second, at speed, position.

In operation, the individual containers 40 are inserted vertically into the spaces 28 and are mounted on the hangers 32 with the mounting surface 35 of the hanger 32 receiving and supporting the mounting surface 48 on the hook-like appendage 46 of the container 40, all as shown in FIG. 2. The inner edge 38 of the arm 34 is received in the crease defined by the junction line 52. Initially, upon rotation of the rotor the engagement between the hanger 32 and the appendage 46, as defined by the engagement of the edge 38 with the crease defined by the junction line 52 prevents radially outward displacement of the container 40 off of the hanger 32. Thereafter, as the rotor is brought to speed, centrifugal force causes the container 40 to pivot in the direction of the arrow 56 from the initial position (FIG. 2, in which the axis of the container lies substantially parallel to the axis of rotation of the rotor), to the second, at-speed, position (FIG. 3, in which the axis of the container is substantially perpendicular to the axis of rotation of the rotor). The pivotal motion occurs about the uninterrupted line of contact defined between the inner edge 38 of the hanger 32 and the crease 52 in the pivot surface on the underside of the appendage 46 of the container 40. This inner edge 38 defines a knife edge contact line on which the pivot surface of the container 40 pivots. The knife edge 38 lies on the vertical axis 40A of the container 40. Pivotal motion of the container 40 beyond the second position in which the axis of the cannister 42 lies substantially perpendicular to the axis of rotation 18 is restrained as the restraining surface 50 on the appendage 46 abuts the undercut surface 36 on the hanger 32. As seen in FIG. 3 the stiffness of the cap 44 and/or the hanger 32 is selected so as to allow the bottom of the cannister 42 to abut in force transmitting contact to the radially inner surface of the bowl 12. As the rotor slows, the reverse of the pivotal action just described occurs.

In view of the foregoing, those skilled in the art having the benefit of the teachings of the present invention as set forth herein may effect numerous modifications thereto. For example, it lies within the contemplation of the present invention to reverse the location of the parts so that the knife edge pivot is defined on the sample container while the corresponding pivot surface is defined on the rotor. Further, any other suitable arrangement may be used to prevent the radially outward displacement of the container off of the hanger 32. In this event the crease in the underside of the appendage 46 may be eliminated and the pivot surface may be planar. Moreover, structure of the rotor 10 may be modified to eliminate the bowl 12 and/or the wedges 22. These and any other modifications are, however, to be be construed as lying within the scope of the present invention as set forth in the appended claims.

What is claimed is:

1. A centrifuge rotor for subjecting a sample of a material carried in a container to a centrifugal force, the rotor comprising a sample container pivot support member defined on one of the rotor or the container with a corresponding pivot surface being defined on the other of the rotor or container, the pivot support member having a knife edge adapted to engage the pivot surface to support pivotal motion of the container along a single uninterrupted line of contact with the pivot surface.

2. A centrifuge rotor for subjecting a sample of a material carried in a sample container to a centrifugal force field, the sample container having a pivot surface thereon, the rotor comprising a sample container pivot support member disposed on the rotor, the sample container pivot support member having a knife edge adapted to receive the pivot surface of the sample container and support the pivotal motion of the container along an uninterrupted line of contact with the pivot surface.

3. The centrifuge rotor of claim 2 wherein the rotor includes a central hub having a hanger extending radially outwardly from the hub, the hanger having the knife edge thereon.

4. The centrifuge rotor of claim 3 wherein the sample container is a substantially cylindrical member having a hook-like appendage, the appendage having the pivot surface thereon.

5. A centrifuge rotor for subjecting a sample of a material carried in a container having a pivot surface thereon to a centrifugal force field, the rotor comprising a central hub having a plurality of radially outwardly extending hangers each hanger having a pivot knife edge thereon, the knife edge on each hanger being adapted to receive the pivot surface of the container along an uninterrupted line of contact and to support the pivotal motion of the container along that uninterrupted line of contact.

* * * * *